US007495158B2

(12) United States Patent
Nagatsuma

(10) Patent No.: US 7,495,158 B2
(45) Date of Patent: Feb. 24, 2009

(54) OPENING/CLOSING MECHANISM FOR A KEYBOARD INSTRUMENT COVER

(75) Inventor: Shigeyuki Nagatsuma, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 11/724,417

(22) Filed: Mar. 15, 2007

(65) Prior Publication Data

US 2007/0218744 A1 Sep. 20, 2007

(30) Foreign Application Priority Data

Mar. 17, 2006 (JP) ..... 2006-074323

(51) Int. Cl.
*G10C 3/02* (2006.01)

(52) U.S. Cl. ..... 84/179; 84/423 R

(58) Field of Classification Search ..... 84/179, 84/177, 178, 184, 185.1, 423 R
See application file for complete search history.

(56) References Cited

U.S. PATENT DOCUMENTS 3,426,829 A * 2/1969 McDaniel et al. ..... 160/201
5,973,241 A 10/1999 Tetsumura
6,673,991 B2 * 1/2004 Hara ..... 84/179

FOREIGN PATENT DOCUMENTS

JP 10-198339 A 7/1998

* cited by examiner

*Primary Examiner*—Walter Benson
*Assistant Examiner*—Jianchun Qin
(74) *Attorney, Agent, or Firm*—Frishauf, Holtz, Goodman & Chick, P.C.

(57) ABSTRACT

An opening and closing mechanism for a keyboard cover that includes a front cover half and a rear cover half coupled foldably by a hinge. The mechanism comprises a first guide that guides the front cover half backward at a front end thereof along the keyboard when the cover is opened and a second guide that backward guides the rear cover half at a front edge thereof along the keyboard and guides the rear cover half obliquely downward at a rear end thereof after the keyboard, thereby rendering the rear cover half upstanding when the cover is opened. Thus, the second guide prevents the rear and front cover halves from lowering at their front and rear ends, respectively, thereby allowing the keyboard cover to be opened and closed smoothly.

9 Claims, 9 Drawing Sheets

OPENING/CLOSING MECHANISM FOR A KEYBOARD INSTRUMENT COVER

BACKGROUND OF THE INVENTION

1. Field of the Invention

The present invention relates to opening/closing mechanisms for a keyboard cover of a keyboard instrument such as an electronic piano.

2. Description of the Related Art

As disclosed in Unexamined Published Japanese Patent Application 10-198339, in order to render compact a case for a keyboard instrument the keyboard cover is composed of front and back cover halves hinged foldably. Thus, when the cover is opened so as to expose the keyboard, the front and rear cover halves are accommodated folded within the case. When the cover is drawn out from the case, the front and rear cover halves are extended substantially flat so as to cover the keyboard.

More particularly, when the front cover half is moved backward to be accommodated within the case, the rear cover half is also moved backward from the keyboard while being gradually bent at the hinge. When the front cover half is accommodated within the case, the rear cover half is accommodated upstanding with its rear end down. When the rear cover half is bent, the front cover half is rendered unstable at its rear part, and in order to avoid this situation, supported at its rear end by an auxiliary mechanism.

More particularly, the auxiliary mechanism comprises a forward and backward turnable normally upstanding support plate that supports the front cover half at its rear end within the case. When the front cover half moves so as to open and the rear cover half starts to fold at its hinge, the support plate supports the front cover half at its rear part with an upper end thereof. When the front cover half moves further so as to open in this state, the support plate turns backward while continuing to support the front cover half at its rear end, thereby restricting further downward movement of the front cover half. When the keyboard cover is closed, the support plate turns forward conversely while continuing to support the front cover half at its rear end as the front cover half moves forward. Then, when the keyboard cover is completely closed, the support plate moves away from the front cover half.

That is, with the conventional opening/closing mechanism for such keyboard cover, the moving front cover half must be supported at its rear part by the auxiliary mechanism when the keyboard cover is accommodated within the case. Further, in order to prevent the support plate of the auxiliary mechanism from hindering the movement of the rear cover half, the support plate must be provided turnable within the case. In addition, the front cover half must be supported at its rear part at all times by the support plate when the keyboard cover is opened/closed and when the keyboard cover is closed, the support plate must be arranged so as to move away from the front cover half.

Thus, with this conventional opening/closing mechanism, fine strict accuracies are required with which the support plate of the auxiliary mechanism is attached at a predetermined position and assembled with other associated parts as well as a wide space is required within the case where the auxiliary mechanism is provided and can operate satisfactorily. This would increase the whole size of the case. Since an obit along which the whole keyboard cover moves is formed by supporting the front cover half at its rear end with the support plate, the front cover half must be longer than the rear cover half, which increases the distance through which the front cover half moves forward and backward, thereby increasing the whole case.

SUMMARY OF THE INVENTION

It is therefore an object of the present invention to provide an opening/closing mechanism for a keyboard cover, capable of opening/closing a keyboard cover smoothly and having a simple structure of a reduced size.

In order to achieve the above object, the present invention provides an opening/closing mechanism for a keyboard cover provided within an musical instrument, the cover comprising a front cover half and a rear cover half coupled foldably by a hinge. The mechanism comprises a first guide for guiding the front cover half backward at its front end along the keyboard when the cover is opened, and a second guide for guiding the rear cover half, which is foldable with respect to the front cover half at the hinge, backward at the front end of the rear cover half along the keyboard when the cover is opened, and for guiding the rear cover half obliquely downward at its rear end after the keyboard so as to render the rear cover half upstanding.

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

DETAILED DESCRIPTION OF THE INVENTION

Figure 1:
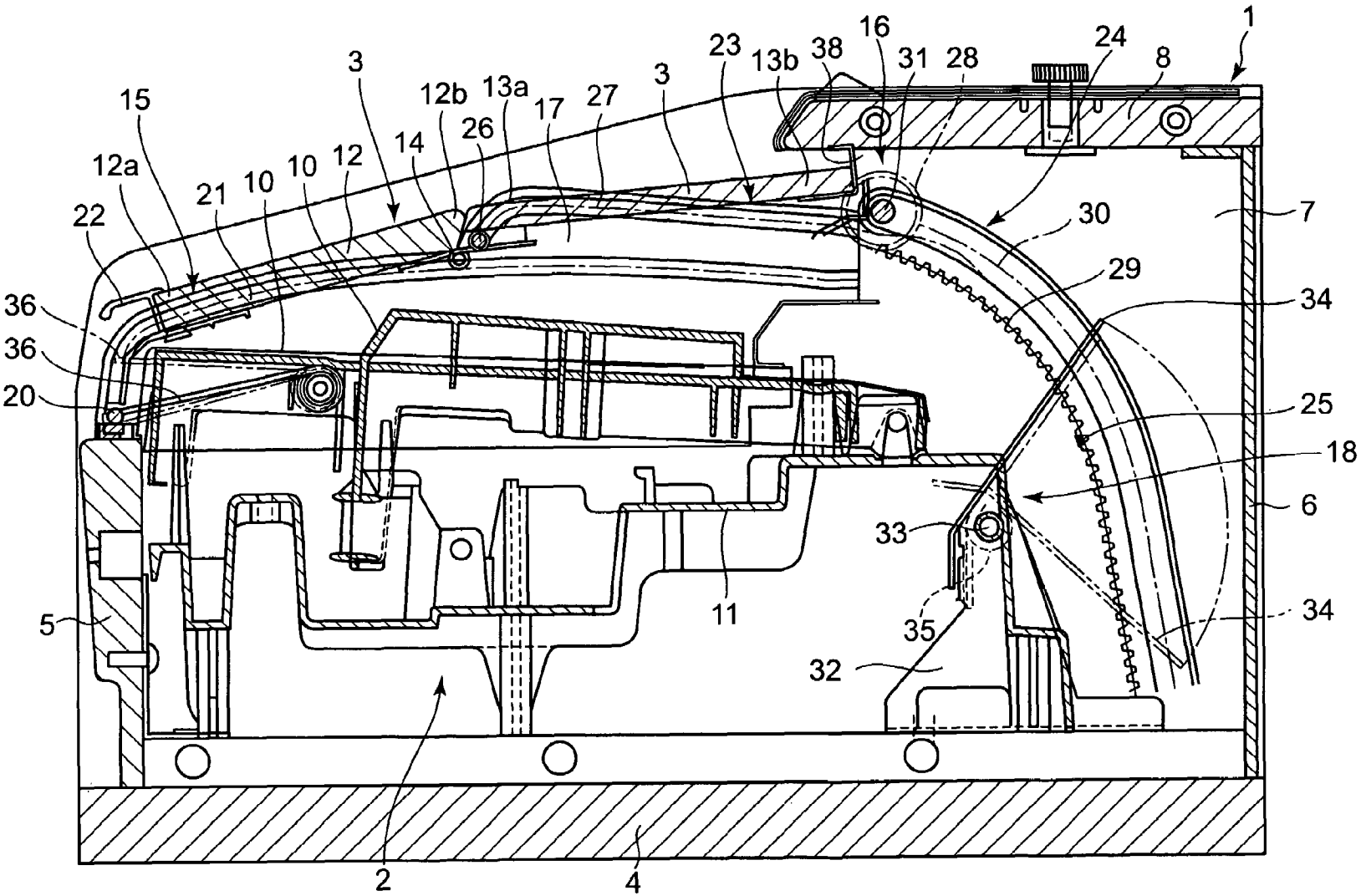
FIG. 1 is a cross-sectional view of a keyboard instrument as an embodiment of the present invention where a keyboard cover composed of a front cover half and a rear cover half is closed.

Referring to FIGS. 1-9, an opening/closing mechanism for a keyboard instrument as an embodiment of the present invention will be described. As shown in FIGS. 1-4, the instrument comprises a keyboard 2 disposed forward (in FIG. 1, left) within a case 1, and an openable keyboard cover 3 provided above the keyboard 2.

As shown in FIGS. 1-4, the case 1 has a bottom 4 and upstanding front and rear plates 5 and 6 provided, respectively, at front and rear ends (left and right in FIG. 1) of the bottom 4. Both upstanding side plates 7 each are provided on a respective one of both sides of the bottom 4 (in FIG. 1, parallel to the plane of FIG. 1). A ceiling 8 is provided between the upper rear parts of the side plates 7 (in FIG. 1, the upper right-hand parts of the side plates). Thus, the case 1 is open upward between the front plate 5 and the ceiling 8 such that the keyboard 2 is exposed in the opening.

As shown in FIGS. 1-4, the keyboard 2 comprises a plurality of white and black keys 10 arranged on a chassis 11 provided on the bottom 4 of the case 1 so as to be exposed in the opening between the front plate 5 and the ceiling 8. As shown in FIGS. 1-5, the keyboard cover 3, which is composed of a front cover half 12 and a rear cover half 13 coupled foldably at a hinge 14, is provided up within the case 1 so as to be movable forward and backward (in FIG. 1, right and left), thereby covering the keyboard 2 openably.

Figure 2:
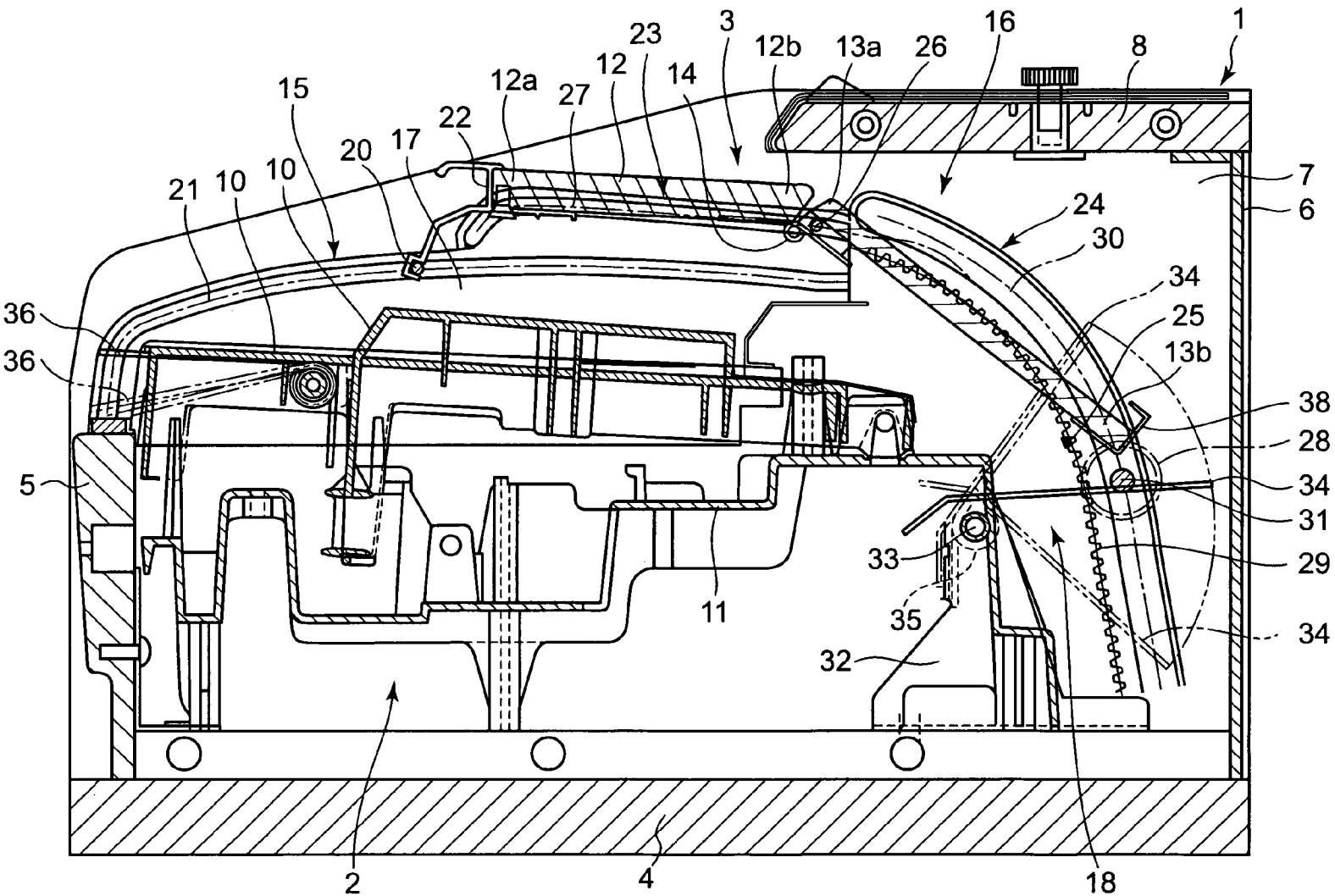
FIG. 2 is a cross-sectional view of the instrument in which the keyboard cover of FIG. 1 starts to open while the rear cover half starts to be folded.
Figure 3:
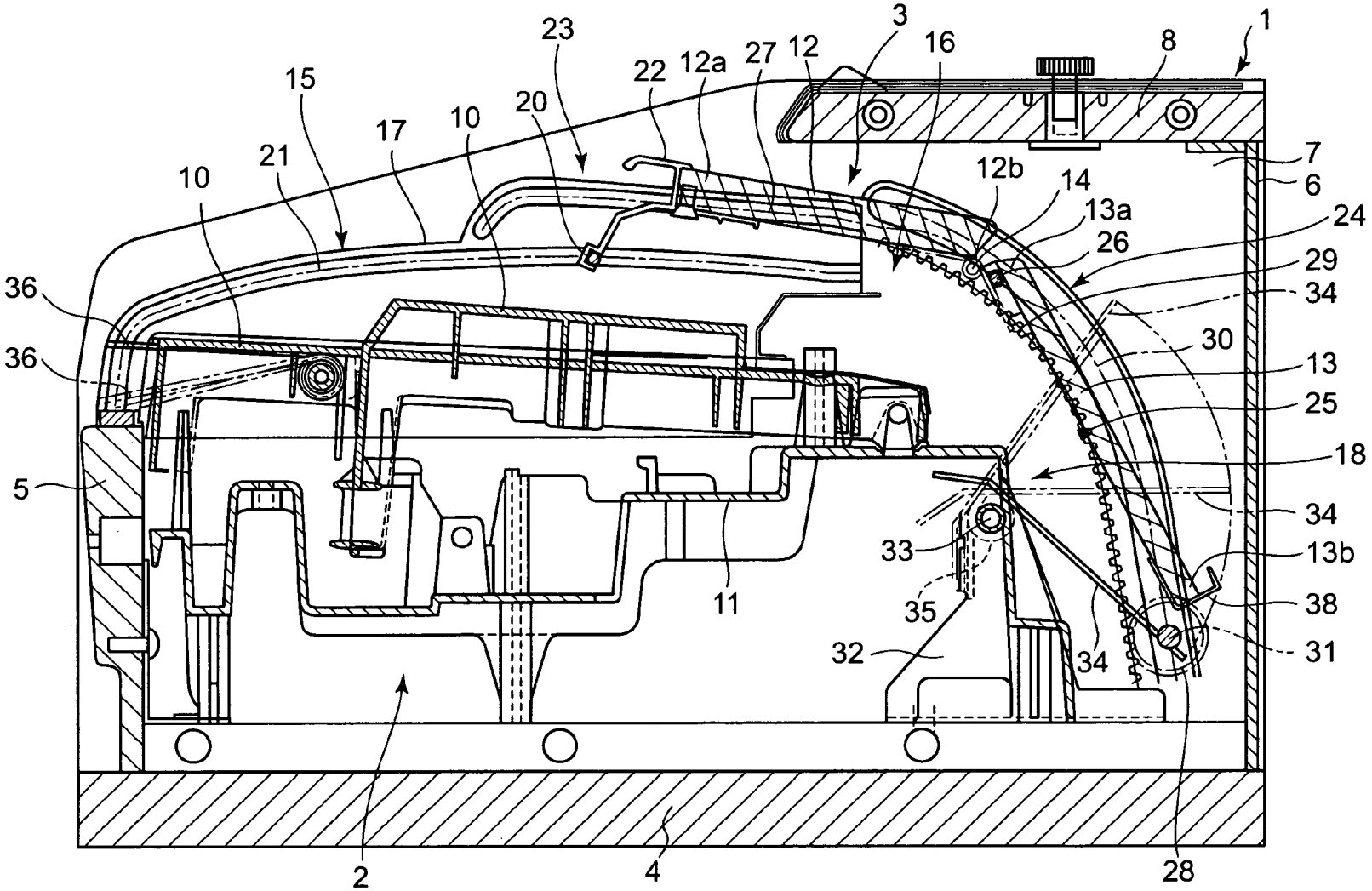
FIG. 3 is a cross-sectional view of the instrument, indicating that the cover of FIG. 2 is further opened while the rear cover half is being folded and moved obliquely downward.
Figure 4:
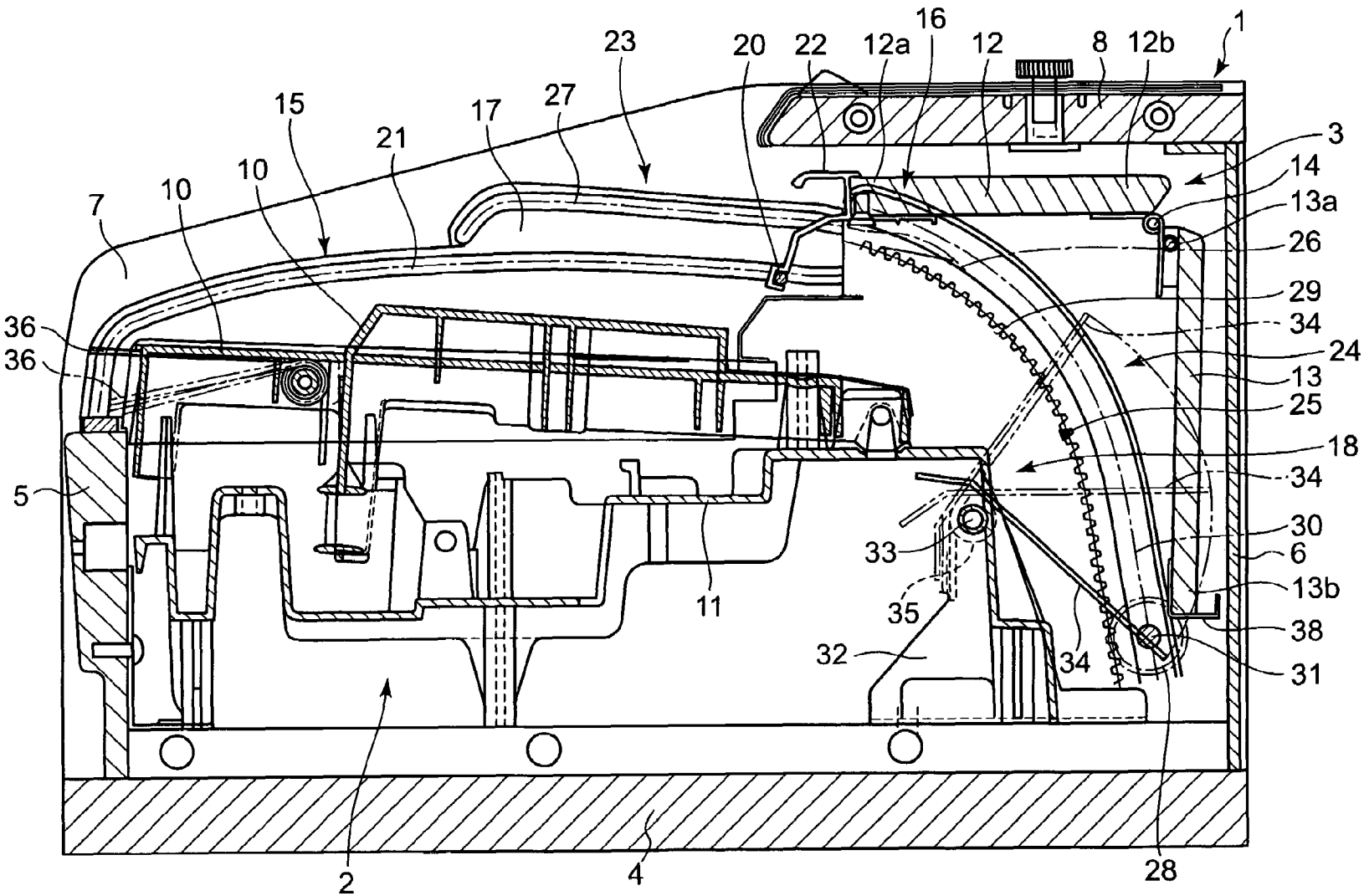
FIG. 4 is a cross-sectional view of the instrument where the cover of FIG. 3 is completely open with the rear cover half upstanding.

As shown in FIGS. 1-5, the opening/closing mechanism for the keyboard cover 3 comprises a first guide 15 that guides the front cover half 12 forward and backward at its front part 12*a* along the keyboard 2 when the cover 3 is opened and closed, and a second guide 16 that backward guides the rear cover half 13 at the front part 13*a* (in FIG. 1, rightward) along the keyboard 2 at substantially the same height as the keyboard 2 and that guides the rear cover half 13 at its rear part 13*b* obliquely downward after the keyboard 2 to render the rear cover half 13 upstanding. In addition, the mechanism comprises a damper 18 supported by the second guide 16 that resiliently holds the rear cover half 13 at its rear end (or a pinion shaft 31 of the rear cover half 13 to be described later in greater detail), as shown in FIGS. 2-4, when the rear cover half 13 becomes upstanding.

Figure 5:
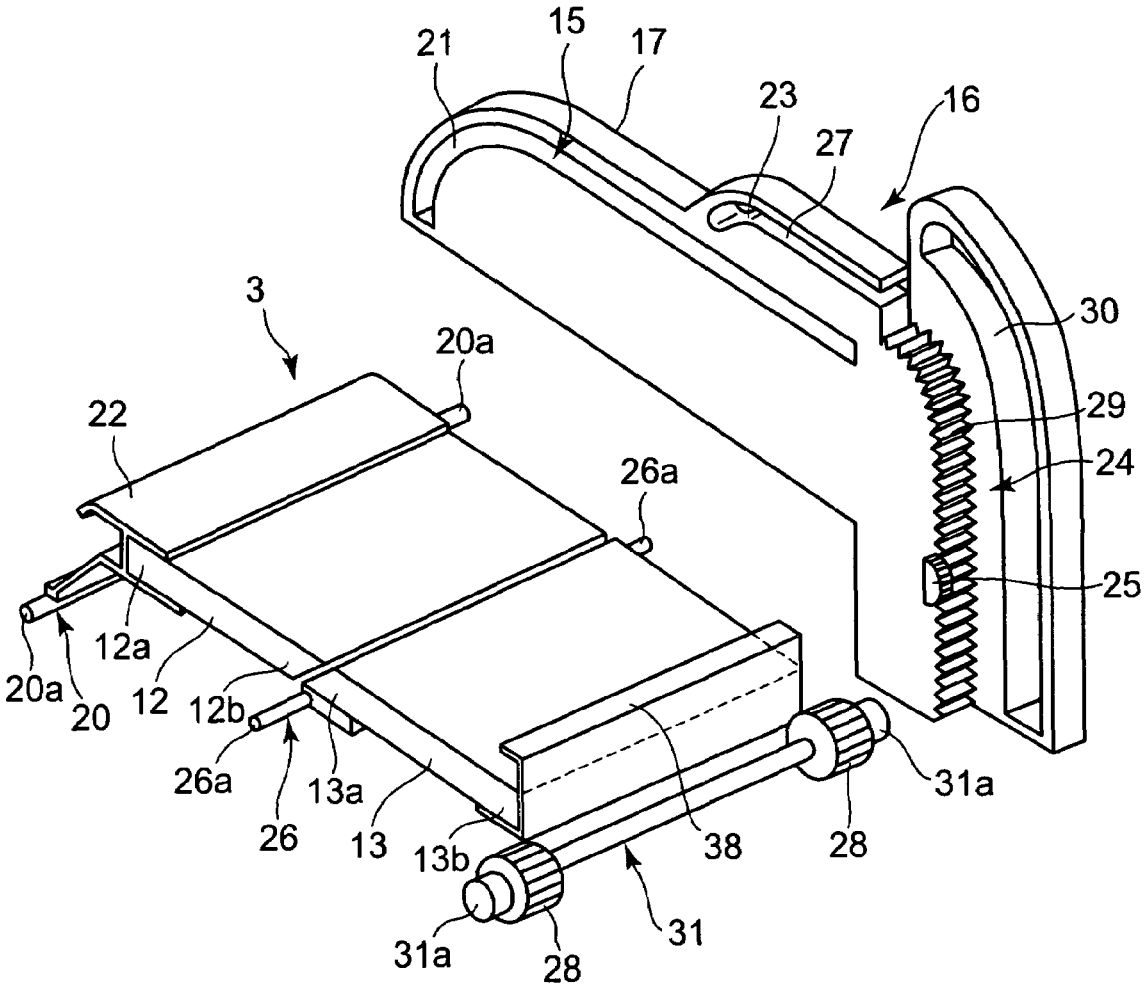
FIG. 5 is an exploited perspective view of an essential portion of a cover opening/closing mechanism for the keyboard instrument according to the present invention, showing in an exploited state the cover, and parts of a first guide and a second guide.

In this case, as shown in FIG. 5 the first and second guides 15 and 16 share a pair of common guide members 17 which are provided on inner surfaces of both the side plates 7, respectively, of the case 1. As shown in FIGS. 1-5, the first guide 15 comprises a first guide shaft 20 provided transversely at the front end 12*a* of the front cover half 12 and a pair of first substantially L-like guide grooves 21 each provided in a respective one of the pair of common guide members 17 so as to rise and then extend horizontally along the keyboard 2 and guide the front cover half 12 forward and backward along the keyboard 2 by receiving both outward ends of the shaft 20.

As shown in FIGS. 1-5, the second guide 16 comprises a front guide part 23 that when the cover 3 is opened, backward guides the rear cover half 13 at its front end 13*a* along the keyboard 2 at substantially the same height as the keyboard 2, a rear guide part 24 that guides the rear cover half 13 at its rear end 13*b* obliquely downward after the keyboard 2 to render the rear cover half 13 upstanding, and a pair of inclination restrictors 25 that when the rear cover half 13 is moved obliquely downward, restricts an inclination of the rear cover half 13 and hence the position of the front end 13*a* of the rear cover half 13 in a vertical plane.

As shown in FIGS. 1-5, the front guide part 23 comprises a second guide shaft 26 provided at a front lower end 13*a* of the rear cover half 13*a*, and a pair of second guide grooves 27 each provided in a respective one of the pair of common guide members 17 that loosely receives the shaft 26 at its opposite outward ends 26*a* so as to be moveable in respective ones of the second guide grooves 27. As shown in FIG. 5, each second guide groove 27 extends substantially parallel to the corresponding first guide groove 21 from a position on the guide member 17 corresponding to substantially the midpoint of the keyboard 2 to a position on the corresponding guide member 17 corresponding to the rear end of the keyboard 2.

As shown in FIGS. 1-6, the rear guide 24 comprises a pinion shaft 31 provided rotatable through an attachment plate (not shown) to the rear end (in FIG. 1, the right-hand end) of the rear cover half 13, a pair of pinions 28 each provided at a respective one of both ends of the pinion shaft 31, a pair of curved racks 29 each provided on a rear edge of a respective one of the pair of common guide members 17, thereby meshing with and rolling on the corresponding ones of the pair of pinions 28, and a pair of curved pinion guide grooves 30 each provided on a respective one of the pair of common guide members 17 so as to correspond in configuration to a corresponding rack 29 to receive and guide the pinion shaft 31 at its both ends 31*a* while causing the pair of pinions 28 to roll along the pair of racks 29, thereby render the rear cover half 13 upstanding when the cover is opened.

Figure 6:
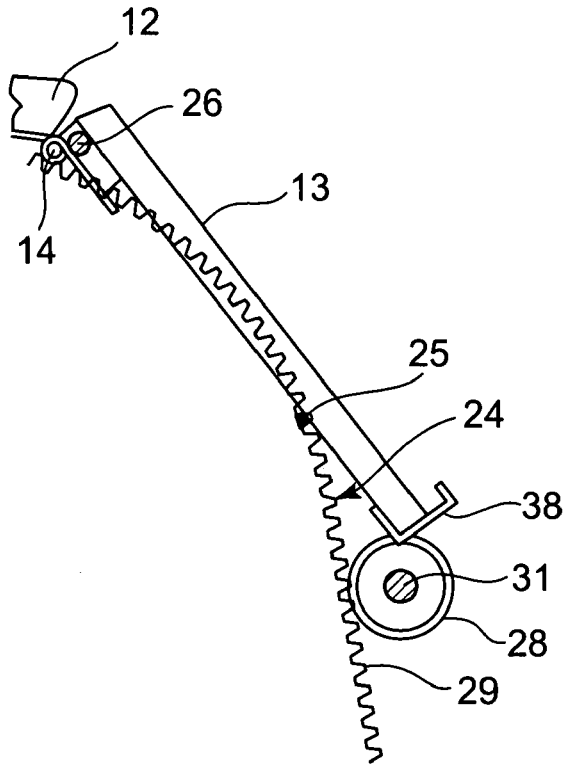
FIG. 6 is a side view of the rear cover half moving while abutting on a pair of inclination restrictors provided on the second guide.

As shown in FIGS. 5 and 6, each inclination restrictor 25 comprises a semicircular convexity provided at substantially a midpoint of the corresponding curved rack 29 on the rear guide part 24 such that when the rear cover half 13 is moved obliquely upward and downward while opening/closing the keyboard cover 3, respectively, the rear cover half 13 slides on the pair of restrictors 25, thereby restricting an inclination of the rear cover half 13.

Figure 8:
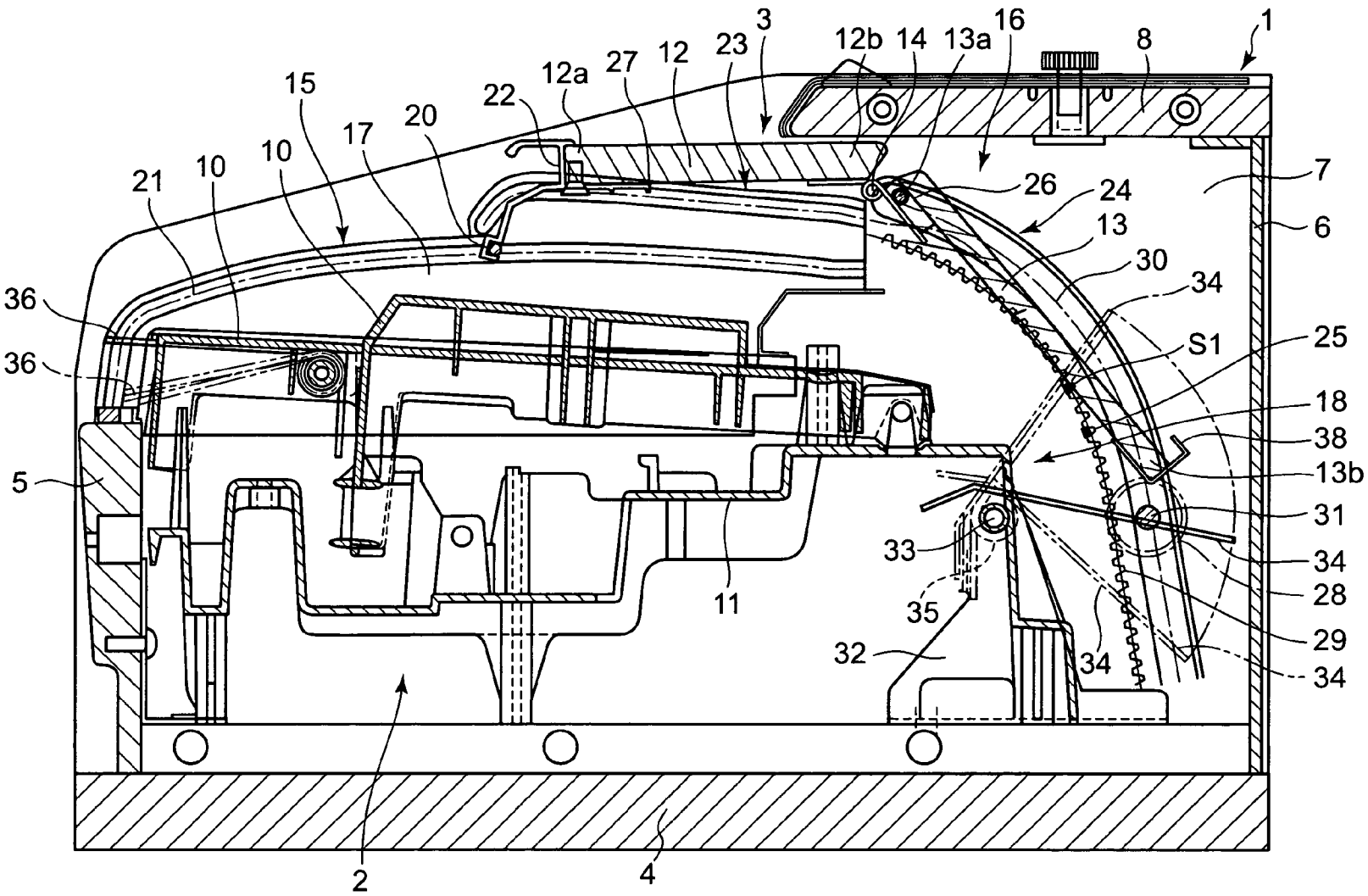
FIG. 8 is a cross-sectional view of the keyboard instrument where a pair of inclination restrictors are provided at a position higher than a predetermined one of FIG. 3.
Figure 9:
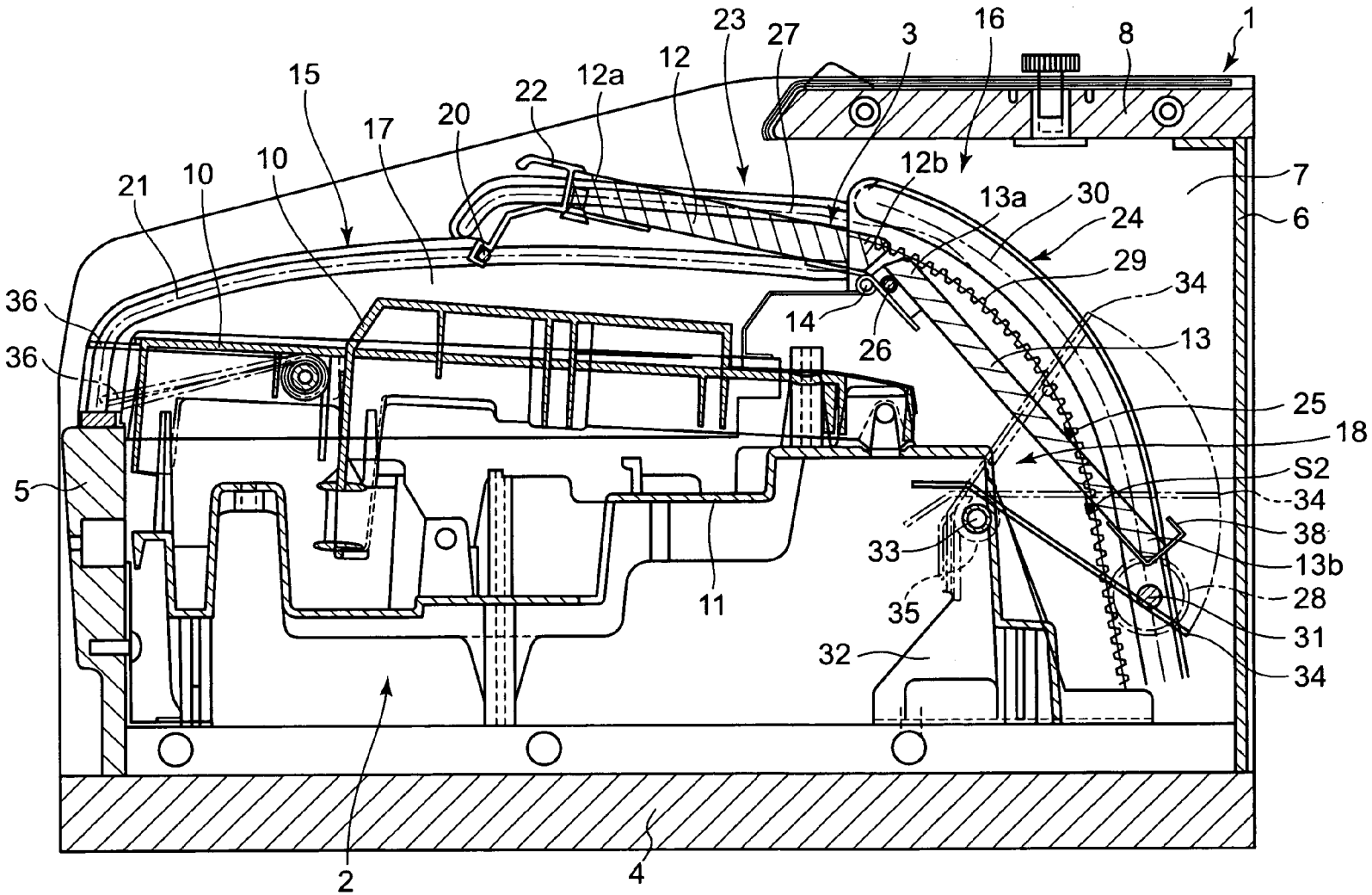
FIG. 9 is a cross sectional view of the instrument where the pair of inclination restrictors are provided at a position lower than the predetermined one of FIG. 3.
Figure 10:
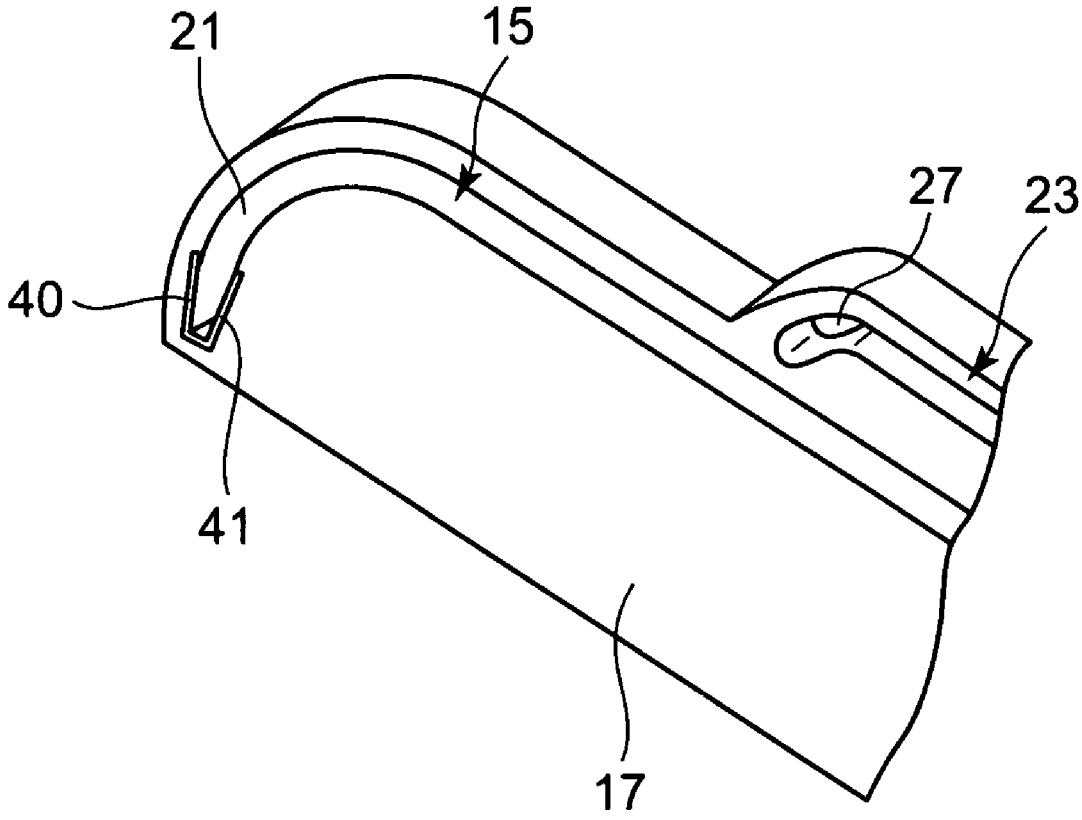
FIG. 10 shows a modification of the torsion spring of FIG. 7 provided in the front portion of the first guide for buffering an impact made by the front cover half.

Assume that the pair of inclination restrictors 25 are provided at positions S1 higher than the predetermined position on the pair of racks 29, as shown in FIG. 8. Then when the rear cover half 13 moves obliquely upward and downward while being inclined, the rear cover half 13 would become too high at its front end 13*a* and the front cover half 12 comes into contact at its rear end 12*b* with the ceiling 8 of the case 1. Conversely, assume that the pair of restrictors 25 are provided at a position S2 lower than the predetermined positions on the pair of racks 29, as shown in FIG. 9. Then, when the rear cover half 13 moves obliquely upward and downward while being inclined, the rear cover half 13 would become too low at its front end 13*a*, thereby causing the rear and front cover halves 13 and 12 to come into contact with the rear part of the keyboard 2.

When the rear cover half 13 moves obliquely downward while being inclined, the damper 18 comes into contact with the pinion shaft 31, thereby restricting the movement of the rear cover half 13 elastically. When the rear cover half 13 becomes upstanding, the damper 18 stops the movement of the rear cover half 13, thereby holding the rear cover half 13 rotatable at its rear end. The damper 18 comprises a base 32 fixed to the bottom 4 of the case 1 after the keyboard 2, an arm 34 rotating around a horizontal shaft 33, attached to the top of the base 32, and a coil spring 35 wound around the shaft 33 to turn the arm 34 upward, thereby causing the arm 34 upward to elastically abut at its end on the pinion shaft 31 so as to push the same upward to reduce the weight of the rear cover half 13.

Figure 7:
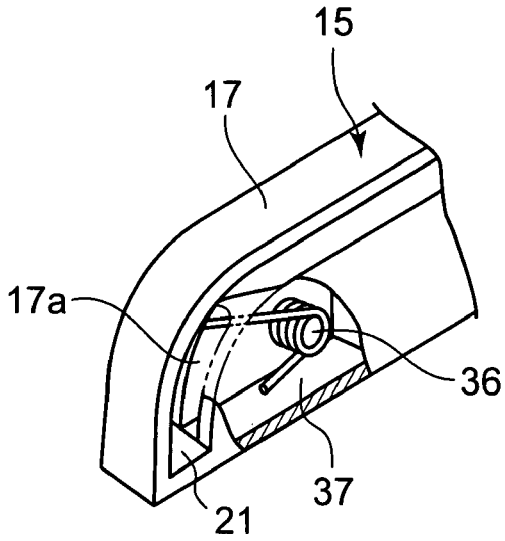
FIG. 7 is a broken away perspective view of a front end portion of the first guide of FIG. 5 where a torsion spring is provided.

As shown in FIG. 7, a pair of torsion springs 36 each are provided within a cavity 37 provided in the front end of a respective one of the pair of common guide members 17 for the first guide 15 below the corresponding first guide groove 21 to alleviate an impact made by the front cover half 12 when the cover 3 is closed. The torsion spring 36 extends at one end into the first guide groove 21 through an elongated opening 17*a* provided between the first guide groove 21 and the underlying cavity 37 so as to abut elastically on the first guide shaft 20 from below, which alleviates an impact which will be made by the front cover half 12 when the cover 3 is closed.

As shown in FIGS. 1-5, a U-shaped cross section elastic guard member 38, for example made of rubber, is provided at the rear end of the rear cover half 13 so as to receive the same with substantially the bottom of the U protruding outward from the rear cover end 13*b*, thereby elastically abutting on the ceiling 8 so as to block a possible gap between the cover and the ceiling 8, when the keyboard cover 3 is closed.

Referring to FIGS. 1-4, the opening/closing operation of the keyboard cover 3 will be described. First, as shown in FIG. 1, when the cover 3 is closed, the front and rear cover halves 12 and 13 are extended substantially flat through the hinge 14 over the keyboard 2. At this time, the both ends 20*a* of the first guide shaft 20 of the first guide 15 provided at the front end 12*a* of the front cover half 12 are received in and positioned at the corresponding front ends of the pair of first guide grooves 21 each provided in a respective one of the pair of guide members 17 with the pair of torsion springs 36 abutting at their ends on the first guide shaft 20 from below.

As shown in FIG. 1, the second guide shaft 26 of the front guide part 23 of the second guide 16 provided at the front end 13*a* of the rear cover half 13 is positioned at both ends thereof in the respective front ends of the pair of second guide grooves 27. The pair of pinions 28 of the rear guide half 24 of the second guide 16 provided at the rear end 13*b* of the rear cover half 13 are positioned at the tops of the pair of racks 29 and the pinion shaft 31 is positioned at its ends 31*a* at the respective tops of the pinion guide grooves 30.

When in this state the front guard 22 of the front cover half 12 is lifted and the keyboard cover 3 is lifted at the front guard 22 of the front cover half 12 and pushed backward within the case 1, as shown in FIG. 2 the front cover half 12 starts to move backward because both ends 20*a* of the first guide shaft 20 provided at the front end 12*a* of the front cover half 12 are received in and guided backward along the respective ones of the pair of the first guide grooves 21. Simultaneously, the rear cover half 13 starts to move backward because the second guide shaft 26 provided at the front end 13*a* of the rear cover half 13 is guided at its ends backward along the respective ones of the pair of second guide grooves 27 each provided in a respective one of the pair of common guide members 17. The pair of pinions 28 of the rear guide 24 provided at the rear end 13*b* of the rear cover half 13 start to roll along the pair of racks 29, respectively. At this time, the pinion shaft 31 at the rear cover end 13*b* starts to move at both ends thereof along the pair of pinion guide grooves 30.

As shown in FIG. 2, at this time the second guide shaft 26 provided at the front end 13*a* of the rear cover half 13 is received at both ends 26*b* of the shaft 26 and moves along the pair of guide grooves 27. Since the rear cover half 13 is supported at its front end 13*a* by the second guide shaft 26 whose ends are supported in the pair of guide grooves 27, the front cover half 12 hinged at 14 to the rear cover half 13 is supported at the rear end 12*b* thereof by the front end 13*a* of the rear cover half 13. As shown in FIG. 2, in this case the rear cover half 13 is gradually downward inclined while being folded at the hinge 14 and the pinion shaft 31 provided at the rear end 13*b* of the rear cover half 13 comes elastically into contact with the damper 18.

Then, when the keyboard cover 3 is further pushed backward within the case 1, the first guide shaft 20 further moves backward at its both ends 20*a* along the respective ones of the pair of first guide grooves 21 of the first guide 15, as shown in FIG. 3. This causes the rear cover half 13 and the second guide shaft 26 attached to the front end 13*a* of the rear cover half 13 to move backward with both ends 26*a* of the second guide shaft 26 guided in the respective ones of the pair of second guide grooves 27. Then the second guide shaft 26 leaves the pair of second guide grooves 27 backward. The pair of pinions 28 of the rear guide 24 roll obliquely downward along the pair of racks 29, respectively. Also, the pinion shaft 31 moves downward with its ends 31*a* guided along the respective ones of the pair of pinion guide grooves 30.

As shown in FIG. 3, at this time the rear cover half 13 moves obliquely downward against the resiliency of the damper 18 while being bent at the hinge 14 with the rear cover half 13 moving downward while being supported by and hence turned around the pair of inclination restrictors 25. Thus, an inclination of the rear cover half 13 is restricted by the pair of restrictors 25. Therefore, even when the second guide shaft 26 provided at the front end 13*a* of the rear cover half 13 leaves the pair of second guide grooves 27 backward, the rear cover half 13 is not greatly lowered at its front end 13*a*, as shown in FIG. 3. Thus, the front cover half 12 is not greatly lowered at its end 12*b* either and moves backward in a substantially horizontal attitude.

When the keyboard cover 3 is further pushed backward within the case 1, the pair of pinions 28 provided at the rear end 13*b* of the rear cover half 13 arrive at the lower ends of the pair of racks 29, respectively, and the pinion shaft 31 arrives at its ends 31*a* at the lower ends of the pair of pinion guide grooves 30, respectively, in which state the pinion shaft 31 is elastically held by the damper 18. At this time, even when the front cover half 12 moves backward, it is prevented from moving downward at its rear end 12*b* because the first guide shaft 20 is supported at both its ends 20*a* the pair of the first guide grooves 21 and the front cover half 12 is supported at its rear end 12*b* by the front end 13*a* of the upstanding rear cover half 13.

When in this state the keyboard cover 3 is further pushed backward within the case 1, the rear cover half 13 is turned backward around the pinion shaft 31 held by the damper 18, thereby getting substantially upstanding, as shown in FIG. 4. Since at this time the rear cover half 13 is turned around the pinion shaft 31 provided at the end 13*b* thereof, the front cover half 12 moves backward in a substantially horizontal attitude without being lowered at its rear end 12*b*. Thus, the front cover half 12 is accommodated substantially parallel to and below the ceiling 8, and the rear cover half 13 is accommodated in a substantially upstanding attitude within the case 1.

When the keyboard 2 is closed by drawing out the cover 3 thus accommodated, the front cover half 12 is lightly lifted up at its front guard 22 and then drawn out, as shown in FIG. 4. While at this time the rear cover half 13 is upstanding and hangs weightily on the damper 18, the rear cover half 13 supported by the damper 18 is turned toward the keyboard 2 around the pinion shaft 31, and pushed upward by the reaction of the damper 18. Thus, the keyboard cover 3 can be smoothly drawn out with a small force. Then, the front and back cover halves 12 and 13 act in a manner reverse to that mentioned above, thereby closing the cover 3 so as to extend over the keyboard 2, as shown in FIG. 1.

As described above, according to the opening/closing mechanism for the keyboard cover 3, when the keyboard cover 3 comprising the front and rear cover halves 12 and 13 coupled foldably by the hinge 14 is opened, the first guide 15 guides the front cover half 12 at its front end 12*a* backward along the keyboard 2 within the case 1. Simultaneously, the second guide 16 guides the rear cover half 13 at its front end

13*a* backward along the keyboard 2 and then obliquely downward, thereby rendering the rear cover half 13 upstanding. Thus, the second guide 16 prevents the rear cover half 13 from lowering at its front end 13*a*. This prevents the front cover half 12 coupled by the hinge 14 to the front end 13*a* of the rear cover half 13 from moving downward at the rear end 12*b* thereof. This renders the rear cover half 13 upstanding smoothly and appropriately at the hinge relative to the front cover half 12.

Thus, although the keyboard cover 3 is composed of the front and rear cover halves 12 and 13 coupled foldably by the hinge 14, the opening/closing mechanism requires no auxiliary mechanism such as the conventional one including the movable support plate. The inventive mechanism has a simple structure in which the second guide 16 guides the rear cover half 13 at its front end 13*a*, thereby preventing the rear cover half 13 and the front cover half 12 from lowering at their front and rear ends 13*a* and 12*b*, respectively, when the cover is opened. Thus, the keyboard cover 3 can be opened smoothly in a stabilized state.

When the keyboard cover 3 is opened, the rear cover half 13 is guided obliquely downward and then accommodated upstanding in a stabilized state within the case 1 by the second guide 16. Thus, the front cover half 12 can have substantially the same size as the rear cover half 13 or shorter than the rear cover half 13. Thus, the distances through which the front and rear cover halves 12 and 13 move forward and backward are reduced and accommodated compactly within the case 1, which serves to further reduce the whole size of the case 1.

Especially, the second guide 16 comprises the front guide part 23 that guides the rear cover half 13 backward at its front end 13*a* at substantially the same height as the keyboard cover 3 along the keyboard 2 when the keyboard cover 3 is opened, and the rear guide part 24 that guides the rear cover half 13 obliquely downward at its rear end 13*b* after the keyboard 2, thereby rendering the rear cover half 13 upstanding, when the keyboard cover 3 is opened. Thus, when the keyboard cover 3 is opened, the front guide 23 guides the rear cover half 13 at its front end 13*a* along the keyboard 2 at substantially the same height as the keyboard 3. Therefore, it is ensured that the front cover half 12 is prevented from lowering at its rear end 12*b*. In this state, the rear guide 24 guides the rear cover half 13 at its rear end 13*b* obliquely downward after the keyboard 2, thereby rendering the rear cover half 13 upstanding. In this case, the rear cover half 13 is gradually bent relative to the front cover half 12 at the hinge 14, which serves to render the rear cover half 13 upstanding smoothly and approximately within the case 1.

The second guide 16 comprises the pair of inclination restrictors 25 that restricts an inclination of the rear cover half 13 when the cover 3 is opened or when the rear cover half 13 moves obliquely downward at its rear end 13*b*, thereby restricting the position of the front end 13*a* of the rear cover half 13 in the vertical plane. Therefore, even when the rear cover half 13 is gradually folded at the hinge 14, the rear cover half 13 is prevented from lowering at its front end 13*a*. Thus, even when the rear cover half 13 moves backward away from the pair of front guides 23, it is ensured that the front cover half 12 coupled to the rear cover half 13 is prevented from lowering at the rear end 12*b* thereof.

When the keyboard cover 3 is opened, the rear and front cover halves 13 and 12 are restricted at their front and rear ends 13*a* and 12*b* with respect to a position in the vertical plane by the pair of inclination restrictors 25. Thus, although the front and rear cover halves 12 and 13 are coupled foldably with the hinge 14, the rear and front cover halves 13 and 12 are prevented from being lowered at their front and rear parts 13*a* and 12*b* while allowing the keyboard cover 3 to be opened appropriately as required. In this case, the pair of inclination restrictors 25 are provided at the predetermined height on the pair of racks 29. Thus, it is ensured that the rear cover half 13 is prevented from moving excessively upward at its front end 13*a*, thereby preventing the front cover half 12 from abutting on the ceiling 8 of the case 1, or the rear cover half 13 is prevented from lowering excessively at its front end 13*a*, thereby preventing the rear and front cover halves 13 and 12 from abutting on the keyboard 2. Thus, the keyboard cover 3 can be opened/closed accurately and appropriately.

The opening/closing mechanism for the keyboard cover 3 comprises the damper 18 that when the cover 3 is opened to render the rear half cover 13 upstanding, absorbs an impact made by the rear cover half 13, thereby holding the same at its rear end 13*b*. Thus, when the keyboard cover 3 is opened to move the rear cover half 13 obliquely downward, thereby rendering it upstanding, the damper 18 prevents the rear cover half 13 from gradually increasing its weight and hence moving rapidly. Thus, the damper 18 can absorb an impact made by the rear cover half 13. Even when the rear cover half 13 is accommodated in an upstanding state, the rear cover half 13 can be lifted up with a light force, using the resiliency of the damper 18 when the cover 3 is opened. Therefore, the cover 3 can be opened/closed with a substantially constant force in a stabilized manner, thereby providing a highly safe convenient opening/closing mechanism.

The pair of torsion springs 36 each are provided at the front of a respective one of the pair of guide members 17 for the first guide 15 to alleviate an impact made by the front cover half 12 when the keyboard cover 3 is closed, thereby preventing the front cover half 12 from being closed rapidly when the keyboard cover 3 is completely closed. Thus, the keyboard cover 3 can be safely closed without any danger of gripping the user's hand or fingers between the front edge 12*a* of the front cover half 12 and the upper end of the front plate 5. The guard 38 provided at the rear end 13*b* of the rear cover half 13 prevents matter such as refuse from entering the case 1 through a possible gap which would otherwise be formed between the rear end 13*b* of the rear cover half 13 and the ceiling 8 of the case 1 when the keyboard cover 3 is closed.

While in the embodiment the pair of torsion springs 36 each are illustrated as provided in a respective one of the front end portions of the pair of common guide members 17, respectively, for the first guide 15 to alleviate an impact made by the front cover half 12 when keyboard cover 3 is closed, a pair of V-like dampers 41 each may be provided within a respective one of complementarily shaped groove parts 40 constituting the front end portions of the first guide grooves 21 provided in the pair of common guide members 17 of the first guide 15, thereby alleviating an impact made by the front cover half 12 when the keyboard cover 3 is closed.

Various modifications and changes may be made thereto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2006-074323 filed on Mar. 17, 2006 and including specification, claims, drawings and summary. The disclosure of the above Japanese patent application is incorporated herein by reference in its entirety.

What is claimed is:

1. An opening and closing mechanism for a keyboard cover of a musical instrument, the cover comprising a front cover half and a rear cover half coupled foldably by a hinge, the mechanism comprising:

a first guide for guiding the front cover half backward at a front end thereof along a keyboard when the cover is opened;

a second guide for guiding the rear cover half, which is foldable with respect to the front cover half at the hinge, backward at a front end of the rear cover half along the keyboard when the cover is opened, and for guiding the rear cover half obliquely downward at a rear end thereof after the keyboard so as to render the rear cover half substantially upstanding; and an inclination restrictor which is provided substantially at a midpoint of a rear guide part such that when the rear cover half is moved obliquely upward and downward while opening and closing the keyboard cover, the rear cover half slides on the inclination restrictor, thereby restricting an inclination of the rear cover half.

2. The opening and closing mechanism of claim 1, wherein the second guide comprises:

a front guide part that guides the rear cover half backward at the front end thereof at substantially a same height as the keyboard along the keyboard when the keyboard cover is opened, and the rear guide part that guides the rear cover half at the rear end thereof obliquely downward after the keyboard, thereby rendering the rear cover half substantially upstanding.

3. The opening and closing mechanism of claim 1, further comprising a damper that absorbs an impact made by the rear cover half and that holds the rear cover half at the rear end thereof when the keyboard cover is opened and the rear cover half is rendered substantially upstanding.

4. The opening and closing mechanism of claim 3, wherein the damper comprises an arm which is configured to elastically abut, at an end portion of the arm, on a pinion shaft provided at the rear end of the rear cover half to thereby absorb the impact made by the rear cover half when the cover is closed, and to push the rear cover half upward when the cover is opened.

5. The opening and closing mechanism of claim 1, further comprising a buffering member which is provided at a front end of the first guide and which alleviates an impact made by the front cover half when the keyboard cover is closed.

6. The opening and closing mechanism of claim 5, wherein the buffering member comprises a torsion spring that is provided in a cavity at the front end of the first guide, and wherein the torsion spring is configured to abut elastically on a guide shaft provided at the front end of the front cover half to thereby alleviate the impact made by the front cover half when the keyboard cover is closed.

7. The opening and closing mechanism of claim 1, further comprising a blocking member which is provided at the rear end of the rear cover half and which blocks a possible gap between the rear end of the rear cover half and an upper end of the instrument case when the keyboard cover is closed.

8. The opening and closing mechanism of claim 1, wherein the inclination restrictor comprises a semicircular convexity that is provided at substantially the midpoint of the rear guide part.

9. The opening and closing mechanism of claim 1, wherein the second guide comprises the rear guide part, and wherein the rear guide part comprises a rack and pinion mechanism to guide the rear end of the rear cover half along a curved rack to thereby render the rear cover half substantially upstanding when the cover is opened.

* * * * *